US011166555B2

(12) United States Patent
Lin

(10) Patent No.: US 11,166,555 B2
(45) Date of Patent: Nov. 9, 2021

(54) ANTI-WOBBLING ADJUSTABLE HEIGHT STOOL

(71) Applicant: Dongguan Shichang Metals Factory Ltd., DongGuan (CN)

(72) Inventor: Chenkang Lin, DongGuan (CN)

(73) Assignee: Dongguan Shichang Metals Factory Ltd., DongGuan (CN)

( * ) Notice: Subject to any disclaimer, the term of this patent is extended or adjusted under 35 U.S.C. 154(b) by 64 days.

(21) Appl. No.: 16/662,731

(22) Filed: Oct. 24, 2019

(65) Prior Publication Data

US 2021/0030154 A1 Feb. 4, 2021

(30) Foreign Application Priority Data

Jul. 29, 2019 (CN) ..... 201910690115.0

(51) Int. Cl.
*A47C 3/24* (2006.01)

(52) U.S. Cl.
CPC ..... *A47C 3/24* (2013.01)

(58) Field of Classification Search
CPC ..... A47C 3/24; A47C 3/245; A47D 1/004; A47B 9/04; A47B 11/00
See application file for complete search history.

(56) References Cited

U.S. PATENT DOCUMENTS 325,443 A 9/1885 Ramseyer
329,654 A 11/1885 Kraemer
468,916 A 2/1892 Lindberg
482,553 A * 9/1892 Fuhrmann ..... A47C 3/24 248/405
550,685 A 12/1895 Munz
1,332,200 A 3/1920 Eugenio
1,435,627 A 11/1922 Uhl
1,783,661 A * 12/1930 Makoski ..... A47C 3/24 108/147
2,415,663 A 2/1947 Charles
2,590,382 A * 3/1952 Danielson ..... A47C 3/245 248/157
3,059,888 A 10/1962 Finn
(Continued)

FOREIGN PATENT DOCUMENTS

FR 1341308 A 10/1963
JP S4728011 Y1 8/1972
TW D153976 S1 6/2013

OTHER PUBLICATIONS

Photographs of three stools, including machine translations of descriptions, Accessed Aug. 6, 2019. 3 pages.
(Continued)

*Primary Examiner* — David R Dunn
*Assistant Examiner* — Tania Abraham
(74) *Attorney, Agent, or Firm* — Luedeka Neely Group, P.C.

(57) ABSTRACT

An anti-wobbling adjustable height stool includes an adjusting screw vaving a threaded seat support spindle and a top spindle head and a stool seat assembly. The stool seat assembly includes a stool seat, and a connecting frame connected with a bottom of the stool seat. The connecting frame is opened with an installation hole, and the spindle head penetrating through and being arranged in the installation hole to enable a tight fit of the spindle head with the connecting frame.

15 Claims, 5 Drawing Sheets

(56) References Cited

U.S. PATENT DOCUMENTS

| | | | | |
|---|---|---|---|---|
| 3,720,442 | A * | 3/1973 | Bergmann | A47C 3/265 297/344.18 |
| 6,079,690 | A * | 6/2000 | Yoon | A47C 3/245 248/622 |
| D717,053 | S | 11/2014 | Gelman | |
| 9,060,612 | B2 * | 6/2015 | Lee | A47C 3/0252 |
| D832,603 | S | 11/2018 | Higgs | |
| 2006/0238008 | A1 * | 10/2006 | Baranov | A47C 9/08 297/338 |
| 2011/0175414 | A1 * | 7/2011 | Asbjornsen | A47C 9/002 297/313 |

OTHER PUBLICATIONS

Extended European Search Report for EP application No. 20166253.3, dated Jun. 8, 2020, 8 pages.

* cited by examiner

ANTI-WOBBLING ADJUSTABLE HEIGHT STOOL

CROSS-REFERENCE TO RELATED APPLICATION

This application claims priority to Chinese Application No. 201910690115.0 filed Jul. 29, 2019, entitled ANTI-SHAKING STOOL STRUCTURE, incorporated herein by reference in its entirety.

FIELD

This disclosure relates to the field of adjustable height stools. More particularly, this disclosure relates to an adjustable height stool of improved construction and aesthetics that is resistant to developing a looseness over time that results in wobbling when a user sits on the stool.

BACKGROUND

Improvement is desired in the construction of adjustable height stools. Conventional adjustable height stools have various shortcomings. For example, many height adjusting devices for these stools are designed in a way that a screw connecting a stool seat penetrates a screw hole in a stool base, and the height may be adjusted through the cooperation of the screw with the screw hole. After a long-term use, a gap between the screw and the screw hole will develop due to multiple repetitive rotational adjustments on the screw. The gap results in wobbling and other undesired movement of the screw in the screw hole.

When a user sits on the stool the weight of the user applied to the wobbling movement of the screw results in uneven stress to be applied to the small contact area of the connection site of the screw and the stool seat. As a result, the stool seat is easy to loosen and wobble, thus affecting the use reliability of the stool. This undesired wobbling of the stool can cause discomfort in sitting and can result in the user falling from the stool.

What is desired is an adjustable height stool that is resistant to developing a looseness over time that results in wobbling when a user sits on the stool.

SUMMARY

In one aspect, an embodiment of an anti-wobbling adjustable height stool according to the disclosure includes an adjusting screw having a threaded seat support spindle and a top spindle head and a stool seat assembly. The stool seat assembly includes a stool seat, and a connecting frame connected with a bottom of the stool seat. The connecting frame is opened with an installation hole, and the spindle head penetrating through and being arranged in the installation hole to enable a tight fit of the spindle head with the connecting frame.

The anti-wobbling adjustable height stool also includes an underframe assembly having a support, an outer tube arranged at a middle of the support and sleeved outside the adjusting screw, the outer tube being internally provided with a nut fit with the threaded seat support spindle, and a rubber pad with a fitting recess arranged between the adjusting screw and the outer tube. A bottom of the adjusting screw is installed in the fitting recess and in interference fit with the rubber pad, a movable gap ranging from 0.070 mm to 0.250 mm being formed between an outer wall of the rubber pad and an inner wall of the outer tube.

In another aspect, an anti-wobbling adjustable height stool according to the disclosure includes a threaded seat support spindle; a support; an outer tube vertically supported by the support and sleeved outside the threaded seat support spindle, the outer tube being internally provided with a nut fit with the threaded seat support spindle, and a pad with a fitting recess arranged between the adjusting screw and the outer tube, a bottom of the adjusting screw being installed in the fitting recess and in interference fit with the pad, a movable gap being formed between an outer wall of the pad and an inner wall of the outer tube.

In a further aspect, an anti-wobbling stool according to the disclosure includes a support spindle having a cone-shaped top spindle head; and a stool seat assembly. The stool seat assembly includes a stool seat, and a connecting frame connected with a bottom of the stool seat. The connecting frame is opened with a cone-shaped installation hole, and the spindle head penetrating through and being arranged in the cone-shaped installation hole to enable a tight fit of the cone-shaped spindle head with the connecting frame.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
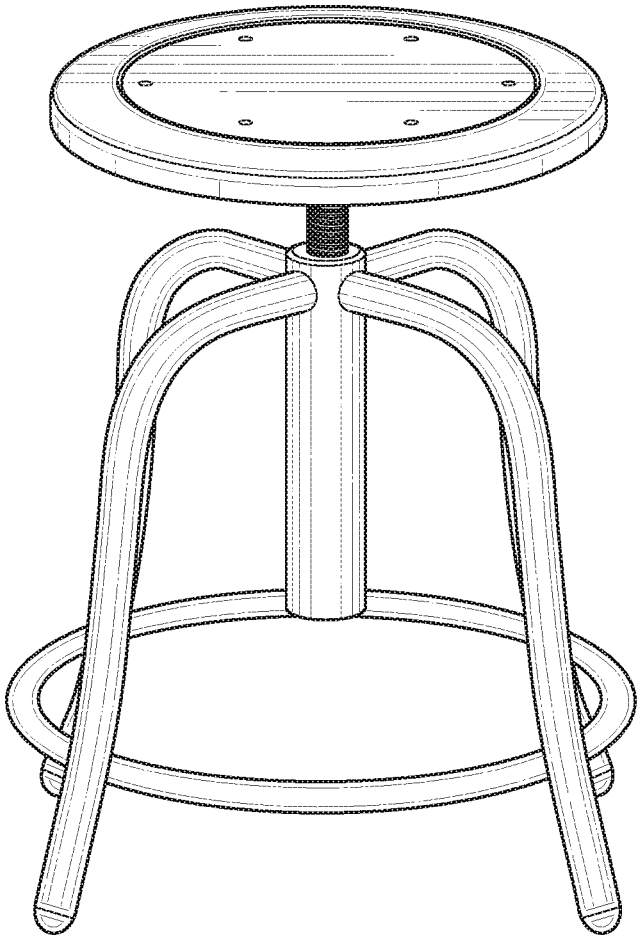
FIG. 1 is a perspective view of an anti-wobbling adjustable height stool according to the disclosure

With reference to the drawings, there is shown an adjustable height stool configured to avoid wobbling and other shortcomings associated with conventional adjustable height stools. The appearance of the stool is also configured to be aesthetically pleasing and includes various ornamental aspects and features.

In the drawing figures, the reference numerals refer to the components of the stool as follows:

| | |
|---|---|
| 10 | Adjusting screw |
| 11 | Threaded seat support spindle |
| 12 | Spindle head |
| 13 | Limit boss |
| 20 | Stool seat |
| 21 | Installation recess |
| 30 | Connecting frame |
| 31 | Installation hole |
| 32 | Supporting plate |
| 321 | Positioning recess |
| 322 | Installation ring |
| 33 | Installation tube |
| 40 | Support |
| 50 | Outer tube |
| 51 | Nut |
| 60 | Rubber pad |
| 61 | Fitting recess |
| 62 | Movable gap |
| 70 | Washer |
| 80 | Bolt |
| 90 | Rivet |

Figure 2:
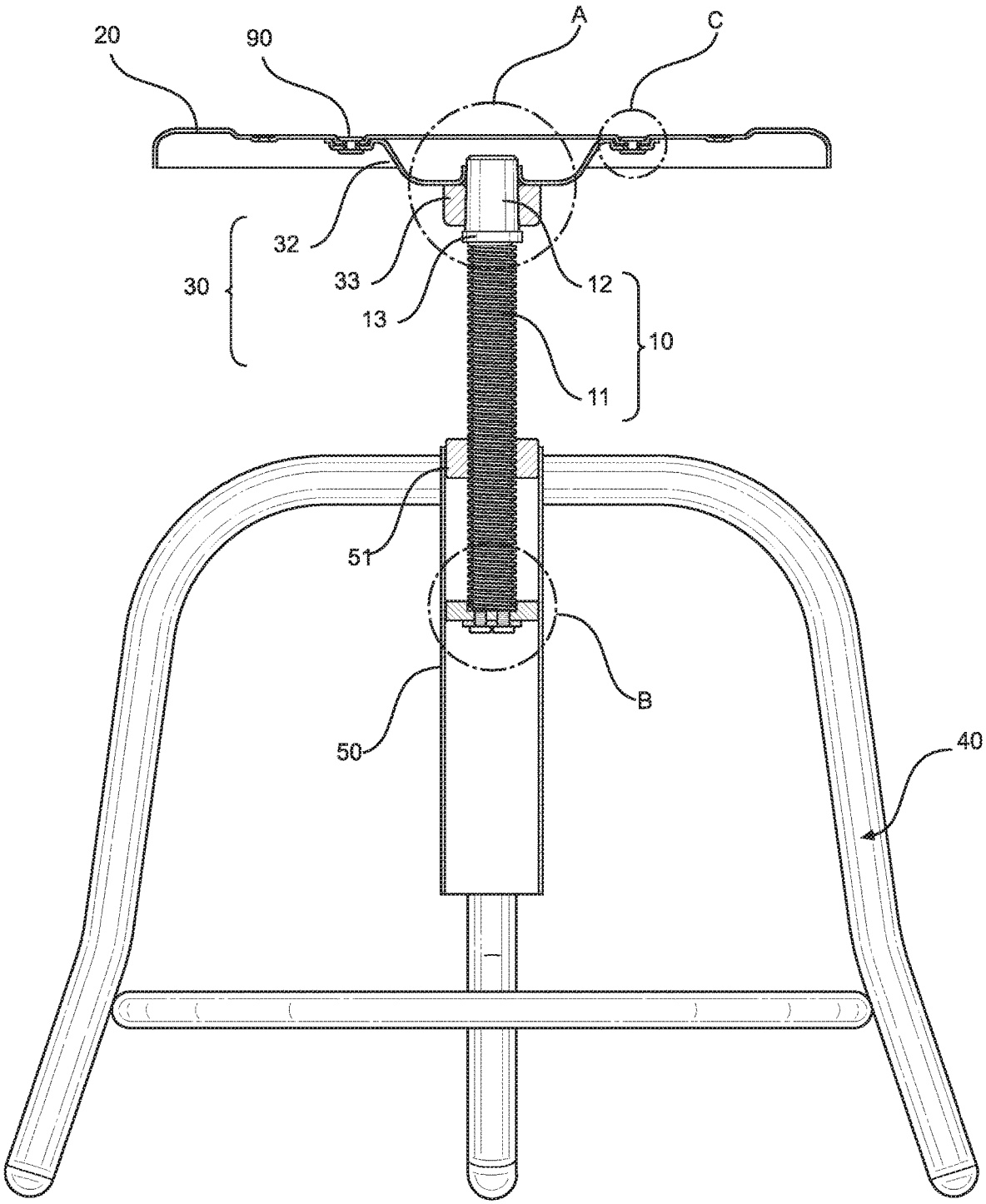
FIG. 2 is a cross-sectional view of the stool of FIG. 1.
Figure 3:
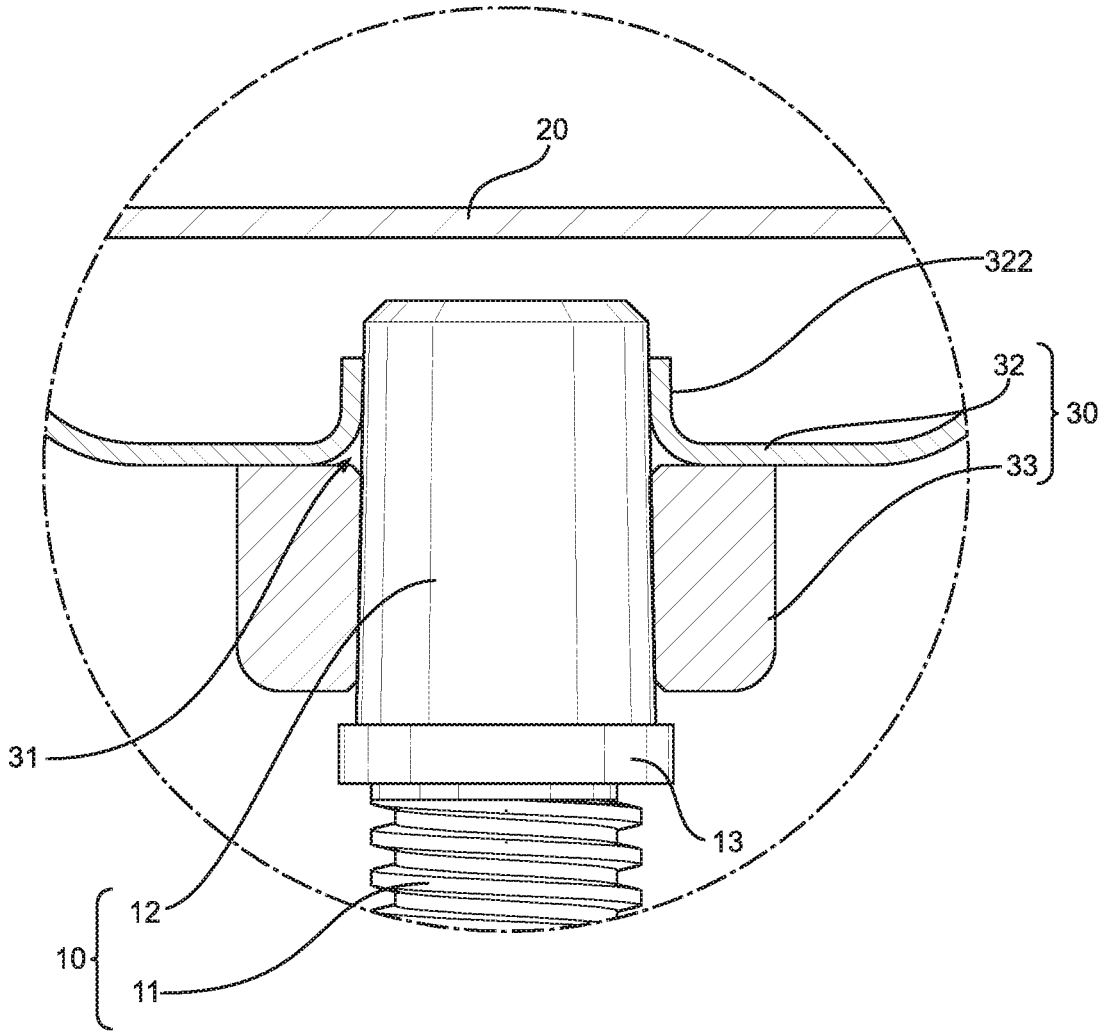
FIG. 3 is an enlarged view of Section A of FIG. 2.

With initial reference to FIGS. 1-3, according to an embodiment of the disclosure an anti-wobbling stool structure is provided, which includes an adjusting screw 10, a stool seat assembly and an underframe assembly. The adjusting screw 10 includes a threaded seat support spindle 11 and a spindle head 12 disposed at an upper end of the threaded seat support spindle 11.

The stool seat assembly includes a stool seat 20 which is fixedly provided at a bottom thereof with a connecting frame 30 having a central installation hole 31. The installation hole 31 is desirably tapered to be a cone-shaped hole. The spindle head 12 penetrates through and is arranged in the installation hole 31, and the spindle head 12 is fittingly engaged with the connecting frame 30. Preferably, the spindle head 12 has a smooth outer surface and has a taper matching the taper of the hole 31 so as to be cone-shaped in mating relationship with the installation hole 31 for facilitating insertion of the spindle head 12 into the installation hole 31 during installation. A limit boss 13 is located at a bottom of the spindle head 12 to limit an insertion depth of the adjusting screw 10, thus preventing excessive insertion which might damage the threaded seat support spindle 11 and the stool seat 20.

In the depicted embodiment, the connecting frame 30 includes a supporting plate 32 fixedly connected with the stool seat 20 and an installation bushing 33 arranged at a bottom of the supporting plate 32. Preferably, a central portion of the support plate 32 is configured to define a void area that defines the installation hole 31, with edges of the support plate 32 surrounding the installation hole 31 curved upwardly to define an installation ring 322. The installation ring 322 is configured to fittingly receive an outer surface of the spindle head 12. The installation ring 322 is integrally arranged with the supporting plate 32 and has a taper consistent with the taper of the spindle head 12.

An inner side wall of the installation tube 33 contacting the spindle head 12 has a taper consistent with the taper of the spindle head 12, and the installation tube 33 is in tapered fit with the spindle head 12. When the taper of the installation ring 322 is slightly deviated with the taper of the spindle head 12 within a tolerance range, the stool seat 20 is prevented from loosening. The installation hole 31 is arranged to penetrate the supporting plate 32 and the installation tube 33.

During assembly of the stool, the spindle head 12 is inserted into the installation hole 31, and the supporting plate 32 and the installation tube 33 are tightly connected with the tapered spindle head 12 through the tapered installation ring 322 and the tapered inner side wall respectively. This is advantageous to provide a large area of contact between the stool seat assembly and the spindle head 12 to provide a tight and reliable connection between the stool seat assembly and the adjusting screw 10.

Preferably, the installation tube 33 is set as a solid bushing, which increases the strength of the connection structure and prevents abrasion, looseness or cracking of a connection part between the stool seat 20 and the adjusting screw 10 after long-term use, thus further ensuring reliable connection. As will be appreciated, the above described structure can be provided to install a seat in a manner to be anti-wobbling even without the height-adjusting aspects of the described embodiment.

In the described embodiment, the underframe assembly includes a support 40 shown configured as three support legs which are positioned to contract the ground or floor surface on which the stool is placed. The underframe assembly also includes an elongate cylindrical sleeve or outer tube 50 located at a middle of the support 40 which is sleeved outside the adjusting screw 10. The outer tube 50 is internally provided with a nut 51 fit with the threaded seat support spindle 11, the nut 51 is fixedly arranged at a top end inside the outer tube 50.

Figure 4:
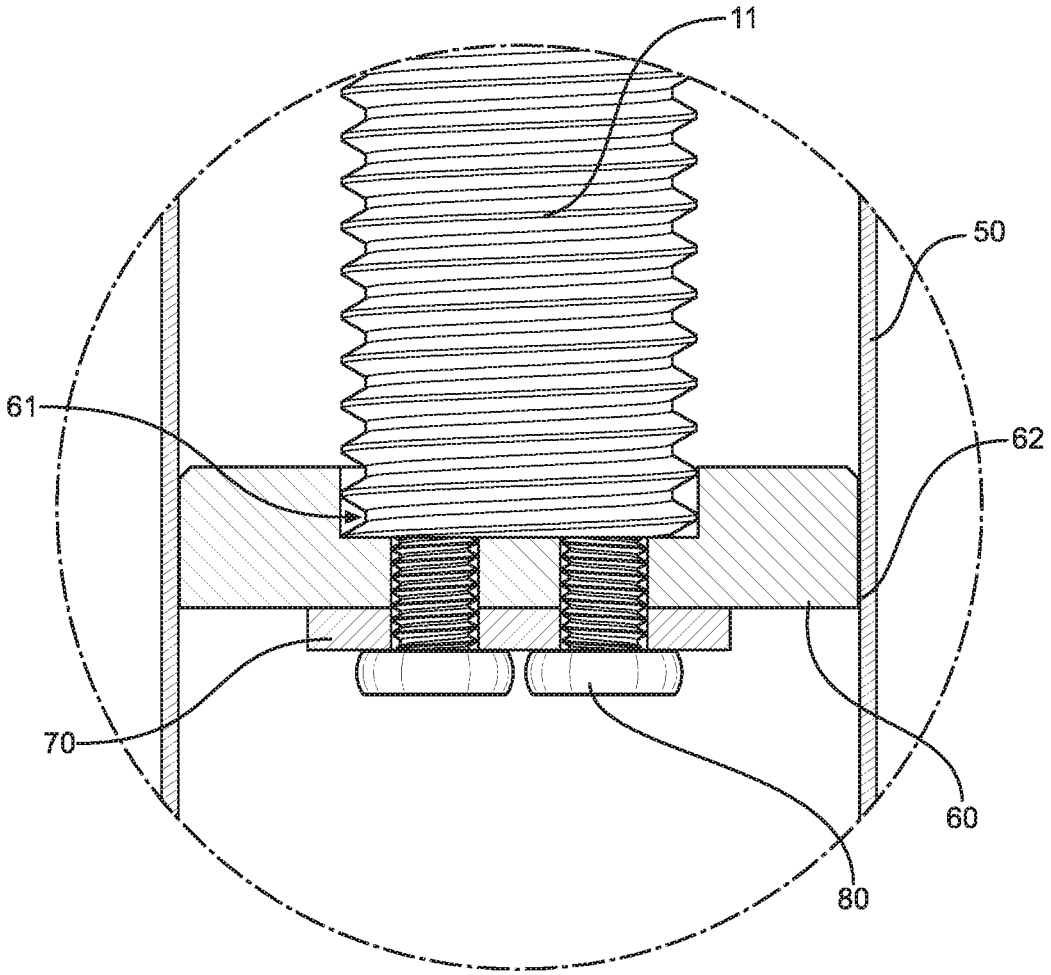
FIG. 4 is an enlarged view of Section B of FIG. 2.

With additional reference to FIG. 4, a rubber pad 60 is arranged between the adjusting screw 10 and the outer tube 50 and a fitting recess 61 is arranged on the rubber pad 60. It will be appreciated that the rubber pad 60 may be formed of deformable materials other than rubber to provide the desired padding effect. A bottom of the adjusting screw 10 is installed in the fitting recess 61 and is in interference fit with the rubber pad 60. A movable gap 62 is formed between an outer wall of the rubber pad 60 and an inner wall of the outer tube 50, and the movable gap 62 ranges from 0.070 mm to 0.250 mm. It will be appreciated that one end of the adjusting screw 10 is fixedly connected with the stool seat 20, the other end of the adjusting screw 10 is inserted into the outer tube 50, the threaded seat support spindle 11 is fit with the nut 51 in the outer tube 50.

A height of the stool seat 20 may be adjusted by rotating the adjusting screw 10. The adjusting screw 10 may be limited in a horizontal direction as by the rubber pad 60 to prevent the adjusting screw 10 and thus the stool seat from wobbling, thereby improving the use experience. Meanwhile, because the adjusting screw 10 is installed in the fitting recess 61 of the rubber pad 60 and is in interference fit with the rubber pad 60, the rubber pad 60 may rotate accordingly when the adjusting screw 10 is rotated. Therefore, the movable gap 62 is arranged between the rubber pad 60 and the outer tube 50 to facilitate the rubber pad 60 to rotate and move up and down in the outer tube 50 along with the adjusting screw 10, and the movable gap 62 is controlled to be within a desired range of 0.070 mm to 0.250 mm.

Preferably, the movable gap 62 is set as 0.1 mm, with an upper deviation of 0.125 mm and a lower deviation of −0.025 mm, which limits a horizontal movement and prevents a limit effect of the rubber pad 60 on the adjusting screw 10 from being invalid due to too large gap, or a friction between the rubber pad 60 and the outer tube 50 from being increased due to too small gap, thus being not conducive to rotation adjustment by the adjusting screw 10, thereby ensuring the adjusting screw 10 to be easily rotated and adjusted without wobbling of the stool seat 20.

In the embodiment, a washer 70 is arranged at a bottom of the rubber pad 60. Preferably, a diameter of the washer 70 is smaller than a diameter of the rubber pad 60 and not smaller than a diameter of the fitting recess 61. The washer 70 and the rubber pad 60 are connected by a plurality of bolts 80. Preferably, two bolts 80 are arranged. It can be understood that, the rubber pad 60 is in interference fit with the adjusting screw 10, when the adjusting screw 10 moves up and down, an acting force is exerted to the rubber pad 60, and in particular, when the adjusting screw 10 moves downwardly, the bottom of the adjusting screw 10 downwardly pushes the rubber pad 60.

Since the adjusting screw 10 is installed in the fitting recess 61 of the rubber pad 60 and the corresponding rubber pad 60 at the fitting recess 61 has a smaller thickness, the rubber pad 60 is easy to be damaged under the force after long-term use. However, by using the washer 70 to support the rubber pad 60, it is prevented that the rubber pad 60 may be damaged under the force and thus effectively prolonging a service life of the rubber pad 60. The washer 70 is fixedly connected with the rubber pad 60 through the bolts 80, thus having a simple structure and convenient installation, and two bolts are used to fix the washer 70, thus preventing the washer 70 from rotating to drive the bolts 80 to rotate, which leads to that the bolts 80 are loosened and fell off, and ensuring reliable connection of the washer 70.

Figure 5:
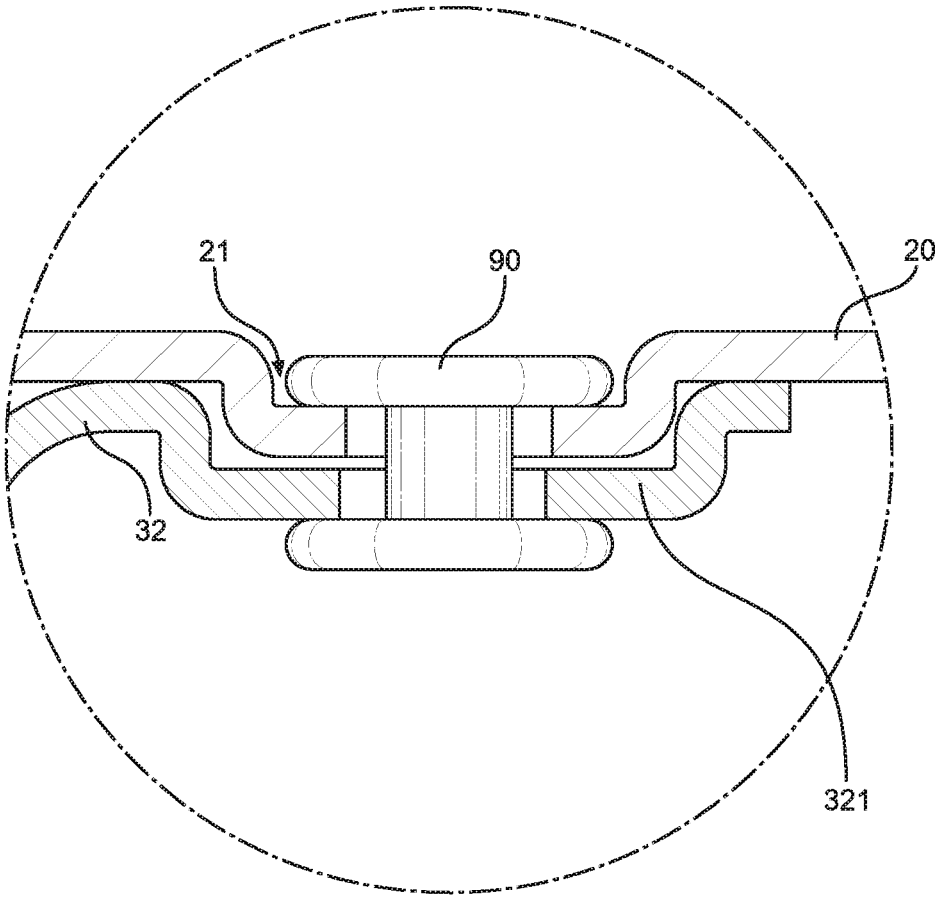
FIG. 5 is an enlarged view of Section C of FIG. 2.

With reference to FIG. 5, in the embodiment, the stool seat 20 and the supporting plate 32 are connected by a plurality of rivets 90. The stool seat 20 is provided with installation recesses 21 for accommodating a respective one of the rivets 90, and the supporting plate 32 is correspondingly provided with a positioning recess 321 for accommodating the installation recess 21. It can be understood that the stool seat 20 and the supporting plate 32 are riveted by the rivets 90, thus having a simple structure and reliable connection, and preventing the stool seat 20 from loosening and falling off with the supporting plate 32. The rivet 90 is installed in the installation recess 21 to enable a top end of the rivet 90 to be flush with a surface of the stool seat 20 to achieve a flat surface of the stool seat 20. The supporting plate 32 is correspondingly provided with the positioning recess 321 to be fit with the installation recess 21, the installation recess 21 and the positioning recess 321 are in one-to-one correspondence during installation to facilitate installation and positioning, and a position of the stool seat 20 is limited in a horizontal direction to prevent the stool seat 20 from shifting relative to the supporting plate 32.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. An anti-wobbling adjustable height stool, comprising:
an adjusting screw comprising a threaded seat support spindle and a top spindle head;
a stool seat assembly, comprising:
a stool seat;
a connecting frame connected with a bottom of the stool seat, wherein the connecting frame is opened with an installation hole, and the spindle head penetrates through and is arranged in the installation hole to enable a tight fit of the spindle head with the connecting frame; and
an underframe assembly, comprising:
a support,
an outer tube arranged at a middle of the support and sleeved outside the adjusting screw, the outer tube being internally provided with a nut fit with the threaded seat support spindle, wherein the nut is fixedly arranged at a top end inside the outer tube, such that the height of the stool seat may be adjusted by rotating the threaded seat support spindle with respect to the nut and the outer tube, and
a pad with a fitting recess arranged between the adjusting screw and the outer tube, a bottom of the threaded seat support spindle being installed in the fitting recess and in interference fit with the pad, such that the pad rotates with the threaded seat support spindle with respect to the outer tube, a movable gap ranging from 0.070 mm to 0.250 mm being formed between an outer wall of the pad and an inner wall of the outer tube.

2. The anti-wobbling adjustable height stool of claim 1, wherein the connecting frame comprises a supporting plate fixedly connected with the stool seat and an installation tube arranged at a bottom of the supporting plate.

3. The anti-wobbling adjustable height stool of claim 2, wherein the stool seat and the supporting plate are connected by a plurality of rivets.

4. The anti-wobbling adjustable height stool of claim 3, wherein the stool seat is provided with an installation recess for accommodating a respective one of the rivets.

5. The anti-wobbling adjustable height stool of claim 4, wherein the supporting plate is provided with a positioning recess for accommodating the installation recess.

6. The anti-wobbling adjustable height stool of claim 1, wherein a limit boss is arranged at a bottom of the spindle head.

7. The anti-wobbling adjustable height stool of claim 1, wherein a washer is arranged at a bottom of the pad.

8. The anti-wobbling adjustable height stool of claim 7, wherein the washer and the pad are connected by a plurality of bolts.

9. The anti-wobbling adjustable height stool of claim 1, wherein the pad is a rubber pad.

10. The anti-wobbling adjustable height stool of claim 1, further comprising:
a washer disposed at a bottom of the pad, the washer having a diameter smaller than a diameter of the pad and not smaller than a diameter of the fitting recess; and
a plurality of bolts that penetrate the washer and the pad to fixedly connect the washer to the bottom of the pad.

11. An anti-wobbling adjustable height stool, comprising:
a threaded seat support spindle;
a support;
an outer tube vertically supported by the support and sleeved outside the threaded seat support spindle, the outer tube being internally provided with a nut fit with the threaded seat support spindle, wherein the nut is fixedly arranged at a top end inside the outer tube, such that the height of the stool may be adjusted by rotating the threaded seat support spindle with respect to the nut and the outer tube, and a pad with a fitting recess arranged between the threaded seat support spindle and the outer tube, a bottom of the threaded seat support being installed in the fitting recess and in interference fit with the pad, such that the pad rotates with the threaded seat support spindle with respect to the outer tube, a movable gap being formed between an outer wall of the pad and an inner wall of the outer tube.

12. The anti-wobbling adjustable height stool of claim 11, wherein the pad is a rubber pad.

13. The anti-wobbling adjustable height stool of claim 11, wherein the movable gap ranges from 0.070 mm to 0.250 mm.

14. The anti-wobbling adjustable height stool of claim 11, further comprising a seat located adjacent an upper end of the threaded seat support spindle, wherein a height of the seat is adjusted by rotation of the threaded seat support spindle relative to the outer tube.

15. The anti-wobbling adjustable height stool of claim 11, further comprising:
the threaded seat support spindle having a spindle head with a cone-shaped top; and
a stool seat assembly, comprising:
a stool seat, a connecting frame connected with a bottom of the stool seat, wherein the connecting frame is open with a cone-shaped installation hole, wherein the cone-shaped top of the spindle head penetrates through and is arranged in the cone-shaped installation hole to enable a tight fit of the cone-shaped top of the spindle head with the connecting frame.

* * * * *